United States Patent [19]

Campbell et al.

[11] Patent Number: 4,499,956

[45] Date of Patent: Feb. 19, 1985

[54] LOCKING MEANS FOR FACILITATING MEASUREMENTS WHILE CORING

[75] Inventors: Frank L. Campbell, Santa Ana; Dean C. Barnum, Fullerton; William C. Corea, Placentia, all of Calif.

[73] Assignee: Chevron Research Company, San Francisco, Calif.

[21] Appl. No.: 522,924

[22] Filed: Aug. 12, 1983

[51] Int. Cl.[3] ..... E21B 47/09

[52] U.S. Cl. ..... 175/46; 175/58

[58] Field of Search ..... 175/46, 45, 40, 58, 175/244; 73/155

[56] References Cited

U.S. PATENT DOCUMENTS

| | | | |
|---|---|---|---|
| 2,929,612 | 3/1960 | Le Bus, Sr. | 175/58 |
| 3,693,428 | 9/1972 | Le Peuvedic et al. | 73/151 |
| 3,982,433 | 9/1976 | Stout | 73/155 |
| 4,134,100 | 1/1979 | Funke | 175/40 |

FOREIGN PATENT DOCUMENTS

| | | | |
|---|---|---|---|
| 0636372 | 12/1978 | U.S.S.R. | 175/46 |

*Primary Examiner*—James A. Leppink
*Assistant Examiner*—Hoang C. Dang
*Attorney, Agent, or Firm*—H. D. Messner; Edward J. Keeling

[57] ABSTRACT

In accordance with the present invention, rotation of the inner barrel relative of the axis of symmetry of the core barrel (indicative of core twist-off or core sand erosion during coring operations) is detected by a novel sensor combination comprising a Hall-effect device imbedded in a support sleeve of a custom safety sub attached to the outer core barrel adjacent to a single signature magnet fitted to and carried by a special support ring attached to the inner barrel. In releasably attaching the inner and outer core barrels together, the special support ring is made to be locking through operation of a series of compression strings acting between the lower surface of the ring and the inner core barrel as to wedge the upper surface of the support ring against an annular stopper ring. Result: the inner core barrel does not rotate relative to the outer core barrel during the trip down to the bottom of the well bore. Before coring commences, the Hall-effect device can be pretested since the signature magnet is locked in circumferential side-by-side relationship with and hence detectable by the Hall-effect device. Increases in mud pressure at the core site, causes release of the support ring (and the magnet) relative to the outer core barrel.

13 Claims, 5 Drawing Figures

LOCKING MEANS FOR FACILITATING MEASUREMENTS WHILE CORING

SCOPE OF THE INVENTION

This invention relates to the art of evaluating an earth formation penetrated by a well bore by means of cores taken from such formation and more particularly, to a method and apparatus for generating useful measurements while the core barrel is positioned in the well bore and is operating to extract the core from the formation. Such information will hereinafter be referrred to as "measurements while coring" or "MWC" data.

BACKGROUND OF THE INVENTION

The development of downhole instrumentation to evaluate drilling and coring of earth formations, has been given impetus by various governmental committees and councils. Prognosis: While instrumentation and uses involving measurements while drilling (or "MWD"), are well-documented, gains to be obtained from measurements while coring (or "MWC") have not yet crystallized. Reasons: Many of most difficult well control problems occur when a core barrel is the well bore. Not only is the ability to handle well kicks reduced (because of reduced circulation capability) but there is increased likelihood of plugging and jamming.

That is to say, the benefits to be gained from MWC during exploratory coring have not been documented in sufficient fashion to outweigh the safety concerns of the field operators. Moreover, the type of real-time data desired or justified, is subject to speculation.

In our prior applications, op. cit., we describe use of a single measurement means mounted adjacent to the uphole terminus of the inner core barrel to monitor rotation of the inner barrel during coring operations. Rotation is determined by any change in repetition interval between uphole recorded mud pulses produced by a mud pulse system at the MWC drilling string segment uphole from the Hall-effect device.

During tripping down of the modified core barrel to the core site, rotation of the inner barrel could occur. It would be beneficial to provide means for releasably locking the inner barrel relative to and adjacent to the imbedded Hall-effect, under such circumstances, so as to facilitate initial testing of the Hall-effect device (to assure operability).

SUMMARY OF THE INVENTION

In accordance with the present invention, a Hall-effect device is imbedded in a custom safety sub attached to the outer core barrel adjacent to a single signature magnet mechanically fitted to a support ring at the uphole terminus of the inner core barrel.

To assure that the inner core barrel does not rotate relative to the outer core barrel during tripping down of the drill string, the support ring for the signature magnet is releasably wedged against the outer core barrel. A series of compression strings act axially between the terminus of the inner core barrel and the support ring and force the support ring into confining engagement with the outer core barrel. To prevent radial movement of the support ring relative to the inner core barrel, the ring is provided with a series of openings into which a set of studs attached to the inner core barrel, reside. The compression strings fit at the exterior of the studs. Result: before coring commences, the Hall-effect device and magnet combination can be pretested since the imbedded signature magnet is assured of being locked in a circumferential, side-by-side relationship with and detectable by the Hall-effect device at the start of coring operation.

Increases in mud pressure at the core site overcomes the unit compression force of the strings and releases the support ring from contact with the outer core barrel. Then, the inner and outer core barrels are free to independently rotate with respect to each other. Thereafter, if the outer barrel is rotated at constant speed to generate a core, production of a series of signals of constant repetition rate is assured. With the occurrence of rotation of the inner core barrel (indicative of core twist-off, or core sand erosion), detection of a change in repetition interval spacing (at uphole indicating equipment connected to the Hall-effect device through MWC mud pulse telemetering equipment) is likewise assured. Result: sticking and jamming of the core can be immediately detected and uphole parameters modified to ease unsafe conditions.

DESCRIPTION OF THE PREFERRED EMBODIMENT

Figure 1:
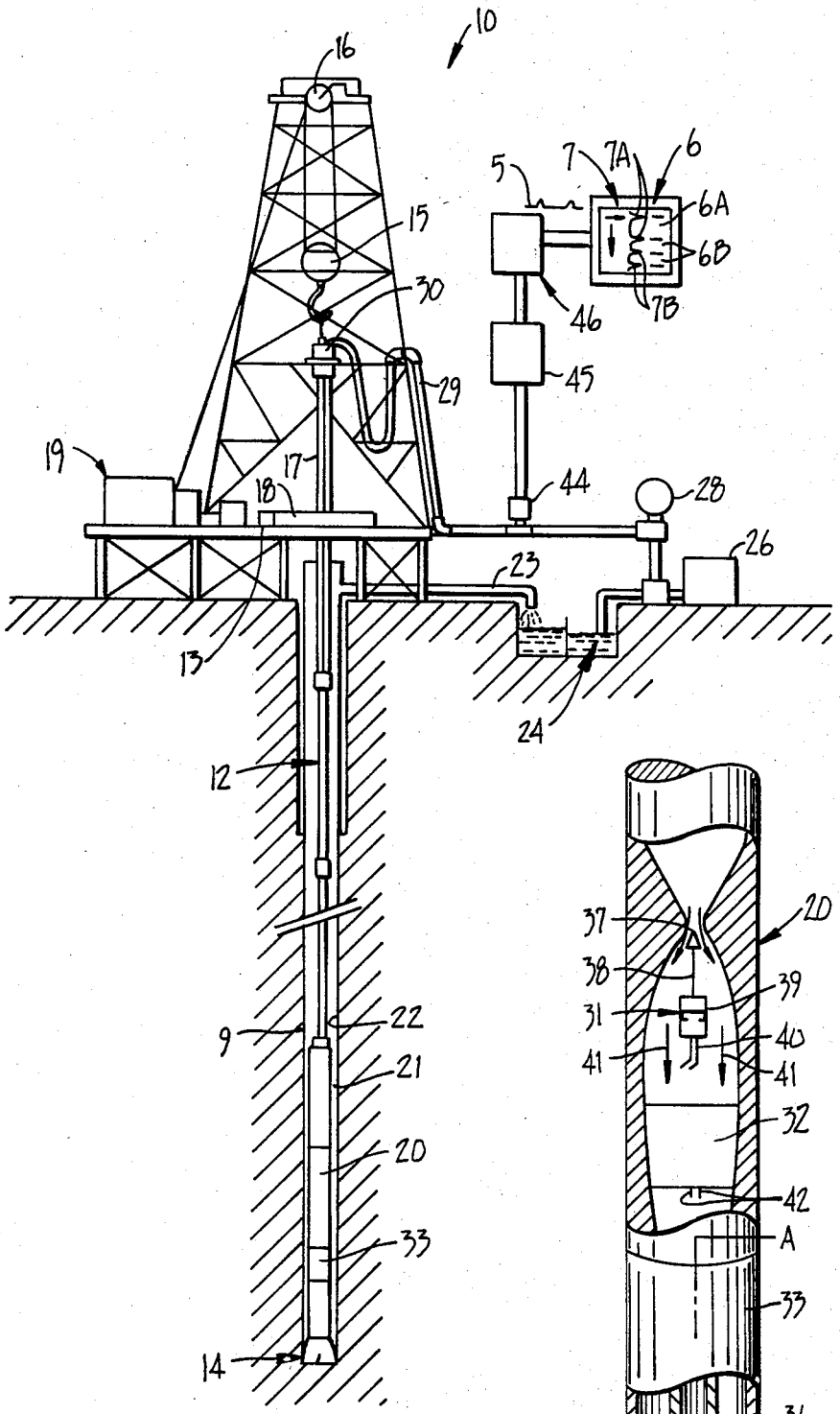
FIG. 1 is a schematic view of a well bore and drilling derrick showing the environment in accordance with the present invention.

Referring now to FIG. 1, the general environment is shown in which the present invention is employed. It will, however, be understood that the generalized showing of FIG. 1 is only for the purpose of showing a representative environment in which the present invention may be used, and there is no intention to limit applicability of the present invention to the specific configuration of FIG. 1.

The coring apparatus shown in FIG. 1 has a derrick 10 which supports a drill string or drill stem 12 which terminates in a core barrel 14. As is well known in the art, the entire string may rotate, or the drill string may be maintained stationary and only the outer core barrel rotated. The drill string 12 is made up of a series of interconnected segments, with new segments being added as the depth of the well increases. The drill string is suspended from a movable block 15 of a winch 16 and the entire drill string is driven in rotation by a square kelly 17 which slidably passes through but is rotatably driven by the rotary table 18 at the foot of the derrick. A motor assembly 19 is connected to both operate winch 16 and rotary table 18.

The lower part of the drill string may contain one or more segments 20 of larger diameter than other segments of the drill string. As is well known in the art, these larger segments may contain sensors and electronic circuitry for sensors, and power sources, such as mud driven turbines which drive generators, to supply the electrical energy for the sensing elements. A typical example of a system in which a mud turbine, generator and sensor elements are included in a lower segment 20 is shown in U.S. Pat. No. 3,693,428 to which reference is hereby made. These elements within segment 20 will hereafter be referenced as "measuring while coring" elements or "MWC" elements. During coring a large mud stream is in circulation. It rises up through the free annular space 21 between the drill string and the wall 22 of well bore 9. That mud is delivered via a pipe 23 to a filtering and decanting system, schematically shown as tank 24. The filtered mud is then sucked by a pump 26, provided with a pulsation absorber 28, and is delivered via line 29 under pressure to a revolving injector head 30 and thence to the interior of the drill string 12 to be delivered to the core barrel 14 as well as to MWC elements within segment 20.

The mud column in drill string 12 also serves as the transmission medium for carrying signals of one or more coring parameters to the surface. This signal transmission is accomplished by the well known technique of mud pulse generation whereby pressure pulses are generated in the mud column at segment 20 in a form capable of being detected at the earth's surface. The signals are representative of a selected coring parameter detected within custom sub 33 above the core barrel 14.

A particular coring parameter to be sensed by the present invention is rotation of the inner barrel 34 (see FIG. 2) even though outer barrel 36 also rotates. But other parameters could also be sensed if desired, along lines previously mentioned.

Figure 2:
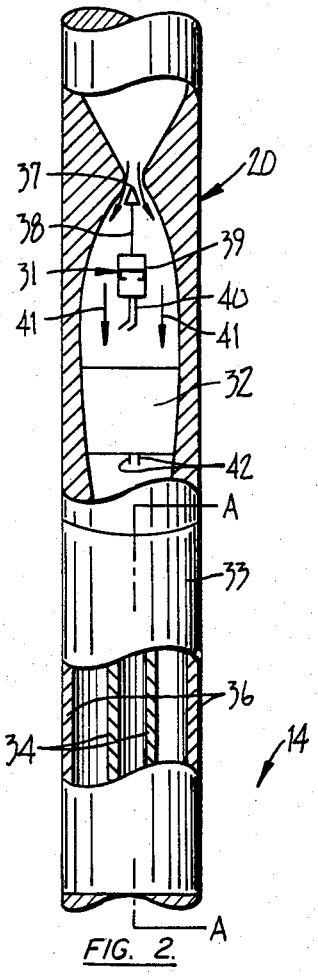
FIG. 2 is an enlarged section of the drill string of FIG. 1 illustrating still further the environment to which the present invention relates.

FIG. 2 also illustrates in schematic form, generation of mud pulses within drill string segment 20 via mud pulse generator 31 so as to provide indication of the aforementioned parameter associated with operations of core barrel 14.

As shown, the drilling mud flows through a variable flow orifice 37 control by plunger 38. The plunger 38 has a valve driver 39 whose electrical conductors 40 extend through battery pack 32 downhole to and make electrical connection with elements within sub 33. The signals generated within the sub 33 cause variations in the size of orifice 37 through controlled movement of the plunger 38 via operation of valve driver 39. Stored energy within the battery pack 31 is transmitted to custom sub 33 via conductors 42 for use in detecting rotation of the inner core barrel 34 about central axis A—A of symmetry as discussed in detail below. As seen in the FIG., mud flow is downward in the direction of arrows 41 and, although impacking upon the battery pack 32 is carried therethrough so as not to hinder mud circulation.

Uphole, the pressure pulses established in the mud stream as a function of the aforemention selected coring parameter, are detected at signal transducer 44 (FIG. 1) which converts the mud pulses to electrical signals having an amplitude (or intensity) proportional to the pressure in the duct. A filter 45 removes parasitic signals due to the steady pressure pulsations of the pump 26 not removed by pulsation absorber 28. Decoding device 46 produces a recorder of signal response 5 whose amplitude v. time characteristic is representative of the coring parameter of interest, as set forth below.

It should be noted that instead of using the electrofluid transducing system of FIG. 2, modifications in this regard are possible. For example, electrical conductors 40 and 42 could be connected—directly—to suitable transducing and decoding means located at the earth's surface. Such direct connection would, of course, be conditioned on the fact that adequate protection of the conductors 40, 42 within the drill string 12 is possible; i.e., conductor abuse during coring operations should be minimal.

As previously indicated, while various classes of coring parameters at core barrel 14 could be sensed during operations, it has been found that in the occurrence of relative rotation of the inner core barrel 34, as the outer barrel 36 is also rotating, is suprisingly indicative of unsafe coring conditions at the bottom of the well bore 9. That is to say, when the inner barrel 34 starts to rotate about central axis of symmetry A—A of sub 33 and core barrel 14, immediate uphole action is necessary. Such occurrance is indicated at decoding device 46 by a change in the repetition interval 6 of signal 5 measured between pulses 7 associated with the coring operation. That is to say, rotation only of the outer core barrel 36 would provide pulses 7A of constant repetition spacing 6A, while rotation of the inner core barrel 34 as the outer core barrel 36 also rotates, produces a changed interval spacing 6B between the adjacent pulses 7B.

In order to ascertain that the change in interval spacing 6B is actually due to inner core barrel rotation (and not caused by just a change in coring speed), the motor assembly 19 (FIG. 1) is fitted with a tachometer means 13. By recording the rotation of tachometer means 13 as a function of time and cross-checking the result with the recorded signal 5 of decoding device 46, the actual occurrence of inner barrel rotation is more easily determinable.

Figure 3:
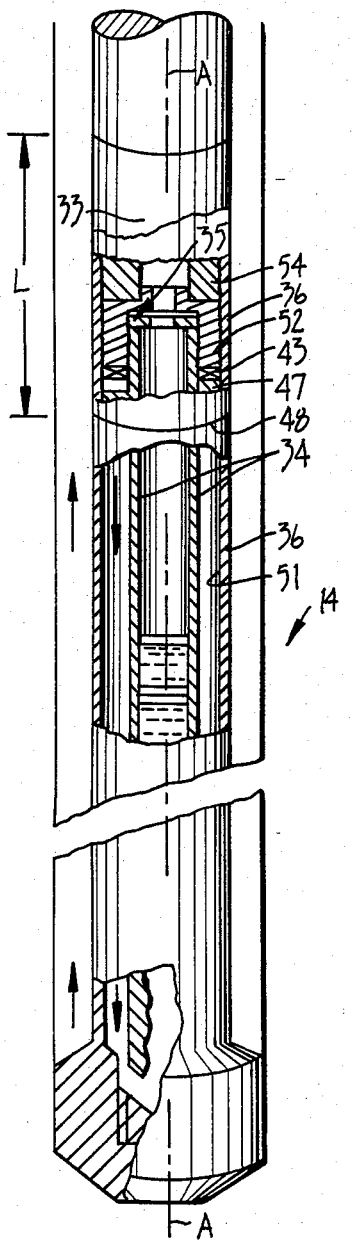
FIG. 3 is a view, partially in section, of a core barrel modified in accordance with the present invention.

FIG. 3 illustrates the construction and operation of core barrel 14, in still more detail, with emphasis being placed on reasons for use of custom sub 33.

Assume that the custom sub 33 has an overall length L equal to that amount of a conventional outer core barrel 36 removed to accommodate sensor unit 35 of the present invention, in safety. I.e., in accordance with a particular design that is useful in the present invention, a conventional core barrel 14 has to be modified as follows. The uphole end of the outer barrel 36 must be cut away, but the remaining terminus should be provided with a flanging surface 48. While the inner barrel 34 remains constructionally intact (except for modifications to mount the sensor unit 35 as discussed below) a new core bearing and race support must be first provided. This is achieved via mounting the removed, previously used, core bearing 43 and its race between ledge 47 (on inner side surface 51 of outer barrel 36) and bottle-shaped retaining sleeve 52. A take-up ring 54 threadable attaches above sleeve 52 to provide needed axial leverage to affix the sleeve 52 and the core bearing 43 in its new operating environment. When the aforementioned modification has been achieved and inserted into a well bore, not only can cores be easily provided, that is, via rotation of the outer barrel 36 through the operations of the drill string as before, but also any rotation of the inner barrel 34 about axis of symmetry A—A can also be detected via sensor unit 35.

Detection occurs via sensor unit 35 wherein operations in accordance with magnetic principles as discussed below, are provided. Since the sensor unit 35 contains no moving parts, it offers high reliability notwithstanding exposure to mechanical shock and vibrations in a well bore environment.

However, note that other types of rotation sensing devices (other than the magneto-electrical type depicted in the FIGS.), can be used during downhole coring operations in accordance with the present invention. For example, a simple electro-mechanical switching circuit could also be used to indicate relative inner barrel rotation, as can an electro-optical system. Both would include a downhole power source momentarily placed in contact with the mud pulsing system of FIG. 2 each time a pair of switch contacts (irrespective of whether or not the latter were mechanical or optical in operation) is closed during relative rotation of the inner barrel. For these systems, such circuit closure would occur only once each revolution of the core barrel, and the contacts would operationally mount between the inner and outer core barrels.

Figure 4:
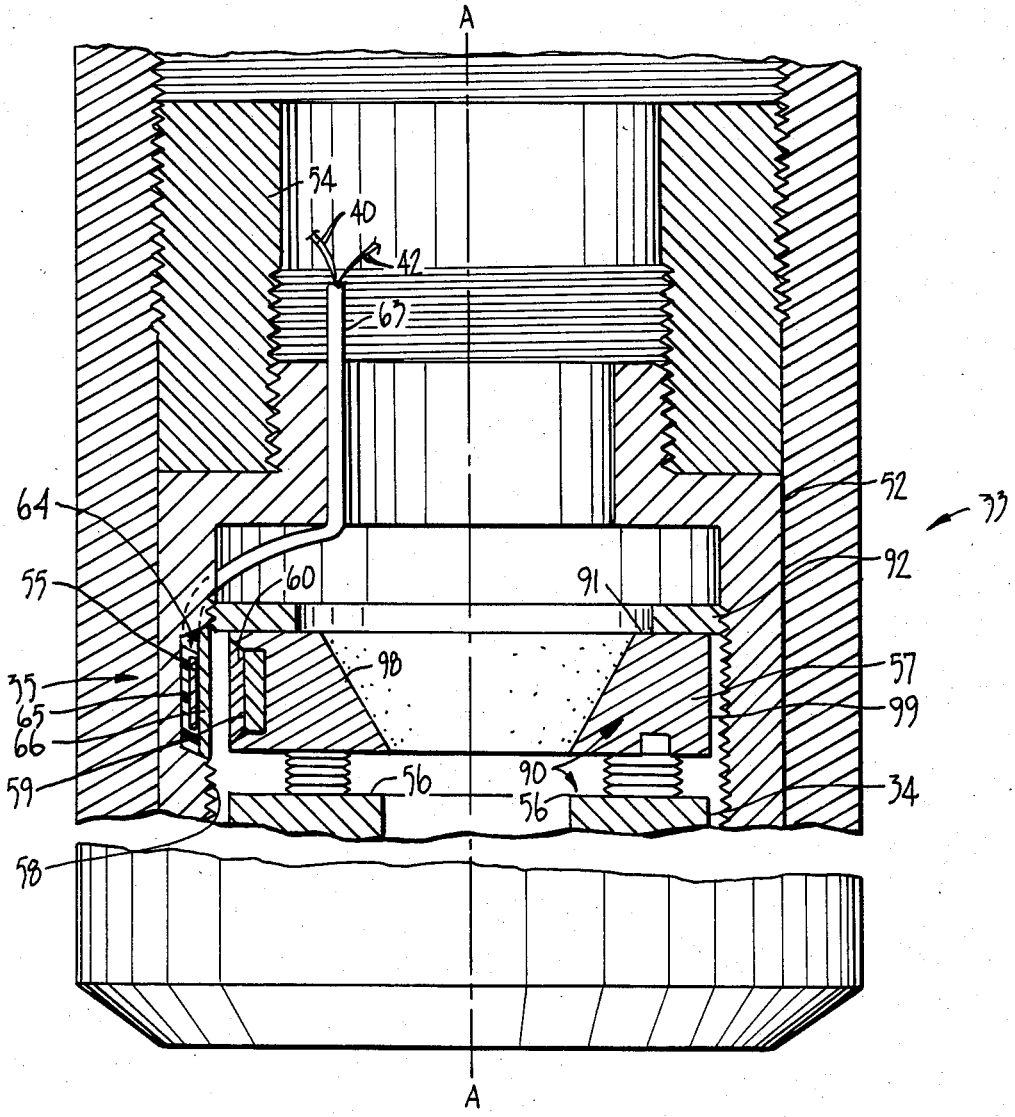
FIGS. 4 and 5 are further details of FIGS. 2 and 3.
Figure 5:
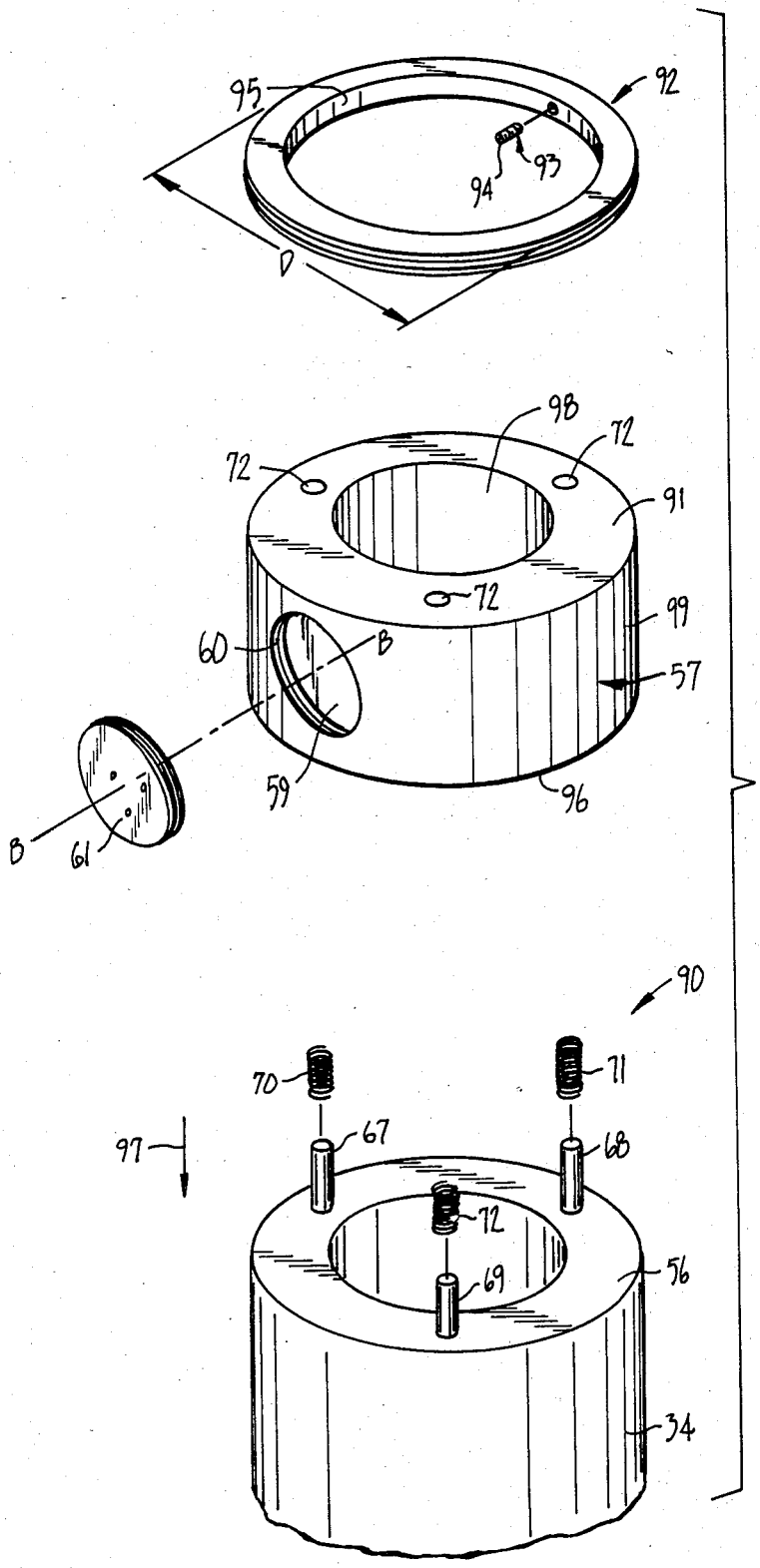

FIGS. 4 and 5 show the sensor unit 35 in more detail.

Although theoretically many kinds of magnetic detection devices could be used as previously mentioned, in this situation the sensor unit 35 of the present invention comprises only two elements: (i) a solid state Hall-effect device 55 mechanically imbedded at inner surface 58 of the previously mentioned retaining sleeve 52 of custom sub 33, but electrically powered by energy developed uphole at battery pack 32. (FIG. 2) above retaining sleeve 54, and (ii) a single signature magnet 59 (see FIG. 5) housed within recess 60 of support ring 57. Reason: low power consumption and rugged physical construction of the combination make such device ideal for operation down-hole. Discussions of Hall-effect devices 55 can be found at "Art of Electronics", Horowitz et al, Cambridge U. Press, 1980 at pages 387 et seq. and 607 et seq., of which reference is made for incorporation herein as to construction and theory of operation.

The output of the Hall-effect device 55 is carried uphole to MWC circuits via the conventional conductors 40 suitably fitted adjacent to power conductors 42 with a common electrical shield 63 to form a conventional wiring harness.

Since the present invention is only used during coring operations and then is removed from the well bore, more ruggedized connector systems that, say, use pressurized oil, as shown in U.S. Pat. No. 4,319,240, are unnecessary.

Rotational movement of the outer barrel 36 about central axis A—A is, of course, contemplated.

During operations, the Hall-effect device 55 and signature magnet 59 are placed adjacent to each other only once each revolution of the core barrel. In the way, a series of signals is generated uphole on a repetitive basis. That is, each time the device 55 passes in close proximity of the signature magnet 59, a signal is generated. Note that the area of proximity varies with the sensitivity of the Hall-effect device 55, but in general is measured over an imaginary sector defined by a cutting plane that intersects the axis of rotation of the core barrel at about 90 degrees. The sector has a mean radial directional vector momentarily along axis B—B (FIG. 5) that intersects the side wall of the well bore; during each revolution of the core barrel, that sector momentarily captures both the Hall-effect device 55 and the signature magnet 59. Since the conductors 40, 42 and shield 63 also rotate about that axis in synchronization with uphole connection points to driver 39 (FIG. 2) and battery pack 32, respectively, tangling of cabling during coring operations is prevented.

To reduce the possibility of drilling mud intrusion yet allow easy removal for repair purposes, the Hall-effect device 55 as well as signature magnet 59 are both provided with suitable mounting arrangements within the retaining sleeve 52 and support ring 57, respectively. In the case of Hall-effect 55, after being potted within epoxy shield 64, it is fitted within a recess 65 formed at the inner surface 58 of the sleeve 52. Recess 65 is capped by a threaded insert 66 through which conductors 40, 42 and shield 63 extend. For magnet 59, its recess 60 (at the circumferential edge of support ring 57, see FIG. 5) is sealed by threadable insert 61 defining an axis B—B normal to, but intersecting the central axis A—A of the assembly.

Of course, the support ring 57 must be affixed to the inner barrel 34 and in accordance with this aspect of the invention, such purpose can be achieved by a mud-releasable locking means generally indicated at 90 in FIG. 4. Such locking means 90 acts between terminus 56 of the inner barrel 34 and the retaining sleeve 52 of the sub 33 through engagement of upper surface 91 of support ring 57 and a prior-mounted stopper ring 92 fixed to the threaded inner wall 58 of retaining sleeve 52.

FIG. 5 shows the stopper ring 92, support ring 57 and locking means 90, in detail.

As shown, the ring 92 has a threaded side surface 93. The diameter D is carefully controlled so that when the ring 92 is threaded within the retaining sleeve 52 of FIG. 4 during the previously described modification process of a conventional core barrel, the thread shape and extent match. A set screw 93 is provided. Its head 94 extends beyond inner surface 95 of ring 92 and its nub (not shown) engages the inner surface 58 of the sleeve 52 of FIG. 4 after the ring 92 has been correctly positioned.

Note also in FIG. 5 that the locking means 90 also includes threaded studs 67, 68 and 69 that screwable attach to the terminus 56 of the inner barrel 34 yet retain compression springs 70, 71, and 72 in active engagement between the terminus 56 and the lower surface 96 of the support ring 57. Above the terminus 56, the studs 67, 68, 69 slidably reside within oversized openings 72 of the support ring 57.

In order to facilitate release of upper surface 91 of support ring 57 from the stopper ring 92 yet keep the ring 57 in operational engagement with the inner barrel 34, the length of the studs relative to the extent of release travel of the ring 57 must be carefully controlled. During release, the direction of axial movement is downward in the direction of arrow 97 against the pressure provided by springs 70, 71 and 72. The increased pressure acting (in the direction of arrow 97) occurs when mud pressure downhole is increased as the coring operation first commences.

Note further in FIGS. 4 and 5 that inner surface 98 of the support ring 57 is not parallel with outer surface 99, which instead is canted so that the wall thickness increases with depth. Thus, when the mud pressure acting over the inner surface 98 is increased, movement of the ring 57 in the direction of arrow 97 is facilitated.

From the foregoing description, one skilled in the art can easily ascertain the essential characteristics of the present invention and without departing from the spirit and scope thereof, can make various changes and modifications of the invention to adapt it to various usages and conditions.

For example, some attention as to the materials to be used in the construction of the custom sub 33, as well as for support ring 57 are needed. Since both assemblies are to be magnetically non-interactive, they should be of stainless steel or monel.

Consequently, such changes and modifications are proper, equitable and intended to be within the full range of equivalence of the following claims.

What is claimed is:

1. Apparatus for monitoring detrimental conditions associated with extraction of a core from an earth formation penetrated by a well bore using a core barrel having a rotatable outer cylindrical barrel attached to and operationally rotated by, a drill string, and drilling fluid circulating within said well bore as said core is extracted, wherein rotation of a usually stationary inner core barrel coaxial of the outer core barrel during said extraction of said core and its placement thereof within the cylindrical inner barrel, is used to indicate said associated detrimental coring conditions, comprising;

locking means disconnectably locking said inner and outer core barrels together during tripping in of said core barrels and said drill string to a selected coring site, said locking means being deactivated by an increase in drilling fluid pressure within said well bore so as to free said inner and outer barrels for independent rotation after said barrels have been correctly positioned at a selected coring site within said well bore;

second means mechanically attached to said core barrel and carried to said core site during tripping in of said drill string and core barrel, said means being operationally fitted relative to said inner and outer barrels for generating a series of electrical signals indicative of relative rotation of said inner core barrel relative to the outer core barrel during core extraction at said core site;

third means uphole from said first and second means but operationally connected to said second means so as to aid in interpreting said series of electrical signals indicative of said relative inner barrel rotation wherein occurrence of said relative inner barrel rotation causes operations to be initiated to overcome any associated detrimental condition within said well bore.

2. Apparatus of claim 1 in which said second means for generating said series of electrical signals indicative of said relative rotation of said inner core barrel during extraction of said core from said formation, includes a Hall-effect device operationally attached to the outer core barrel and carried in rotation therewith, and a single signature magnet fitted to said inner core barrel wherein said series of signals are generated by said Hall-effect device on a repetitive basis each time said Hall-effect device passes in close proximity of said single signature magnet, said region of close proximity being defined by a cutting plane that intersects the axis of rotation of the core barrel at about 90 degrees, said imaginary sector momentarily capturing said Hall-effect device and said single magnet during rotation thereof.

3. Apparatus of claim 2 with the addition of downhole battery means electrically connected to said Hall-effect device for powering said device during coring operations on a continuous basis thereby said series of signals can be generated as the output of said Hall-effect device as repetitive passage of said device adjacent to said single signature magnet over said region of proximity occurs.

4. Apparatus of claim 2 in which said locking means disconnectably locking said inner and outer core barrels together comprises a support ring releasably mounted between an upper terminus of said inner core barrel and said outer core barrel, a series of compression springs mounted between said support ring and said terminus of said inner core barrel having axes colinear with that of said inner core barrel, and a series of studs fixedly attached to said terminus of said inner barrel and slidably residing within openings within said support ring, said openings being large enough to slidably accommodate said studs but being too small to accept said springs whereby an upwardly directed spring force is generated so as to releasably wedge said support ring against said outer core barrel during tripping in of said string and said core barrel.

5. Apparatus of claim 4 in which said locking means also includes a separate stopper ring fixedly attached to an inner surface of said outer core barrel and positioned to make wedging contact with an upper surface of said support ring to thereby releasable lock said inner and outer core barrels together during tripping in of said drill string.

6. Apparatus in accordance with claim 4 wherein said support ring has a side wall that varies in thickness in the direction of drill mud circulation whereby increases in drilling fluid pressure, cause downhole movement of said support ring to release said support ring from wedging contact with said outer core barrel.

7. Apparatus of claim 2 in which said second means also includes a mud pulse generating means connected to the output of said Hall-effect device and generating a second series of signals in response to said series of electrical signals, said second series of signals being in the form of pressure impulses imparted to the drilling fluid, said mud pulse generating means being housed in said separate drill string segment uphole of said locking means.

8. Apparatus of claim 7 in which said third means includes transducer means at the earth's surface for converting the pressure impulses imparted to the drilling fluid to surface electrical signals having amplitude variations proportional to the pressure impulses, and recording means connected to said transducer means for recording said surface electrical signals as a function of time.

9. Method of monitoring the extraction of a core from an earth formation penetrated by a well bore using a core barrel having a rotatable cylindrical outer barrel attached to a drill string, drilling fluid circulating with the well bore to aid in cutting the core from the formation, and a normally stationary cylindrical inner barrel coaxial of the outer barrel to receive the core therein, whereby detrimental coring conditions within the well bore are economically indicated, comprising:

(i) attaching the core barrel, fitted with means to monitor rotation of the inner barrel, to the drill string, (ii) releasably locking the inner and outer core barrels together to prevent relative rotation during tripping in of the drill string and core barrel to a core site at a selected depth within the well bore, (iii) tripping in the drill string and core barrel to the selected coring site, (iv) releasing the inner and outer core barrels from attachment to each other, (v) rotating the outer core barrel while drilling mud is being circulated to cut the core from the formation while simultaneously causing the core to be located interior of the cylindrical inner core barrel, (vi) detecting by downhole battery powered means attached to said core barrel, rotation of the inner core barrel relative to the outer core barrel via a series of electrical signals indicative thereof, (vii) monitoring said series of signals at the earth's surface adjacent to the well bore so that when inner barrel rotation does occur, operations can be initiated to overcome any detrimental condition within the well bore so indicated.

10. Method of claim 9 in which step (iv) of releasing the inner and outer core barrels, is initiated by increases in drill fluid pressure to cause axial movement of the inner core barrel so as to cause its release from wedging contact with the outer core barrel.

11. The method of claim 10 in which step (vii) is further characterized by the sub-steps of:

establishing a signal repetition rate for said series of signals wherein said inner core barrel is known not to rotate, and comparing that rate with a subsequently generated changed rate resulting from inner barrel rotation.

12. The method of claim 10 in which step (vi) is further characterized by the sub-steps of:

generating a series of electrical signals, each signal of said series having a characteristic indicative of the coincidence of a known point on the rotating outer core barrel being adjacent to a known point on the normally stationary inner core barrel defining a region of proximity for signal generation, transmitting said series of electrical signals uphole from said core barrel.

13. The method of claim 12 with the additional sub-steps of:

converting said series of electrical signals to a series pressure impulses imparted to the drilling fluid, and reconverting at the earth's surface said pressure impulses to second series of electrical signals, recording the second series of signals as a function of time.

* * * * *